US006584886B2

(12) United States Patent
Sugiura et al.

(10) Patent No.: US 6,584,886 B2
(45) Date of Patent: Jul. 1, 2003

(54) COMPRESSOR

(75) Inventors: Manabu Sugiura, Kariya (JP); Takayuki Kato, Kariya (JP); Takahiro Sugioka, Kariya (JP); Masahiro Kawaguchi, Kariya (JP); Hiroaki Kayukawa, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/908,127

(22) Filed: Jul. 18, 2001

(65) Prior Publication Data

US 2002/0025259 A1 Feb. 28, 2002

(30) Foreign Application Priority Data

Jul. 26, 2000 (JP) ..... 2000-225908

(51) Int. Cl.[7] ..... F01B 3/00
(52) U.S. Cl. ..... 92/71; 92/155
(58) Field of Search ..... 92/71, 12.1, 12.2, 92/155

(56) References Cited

U.S. PATENT DOCUMENTS 5,943,941 A * 8/1999 Kato et al. ..... 92/71
5,947,003 A * 9/1999 Jepsen et al. ..... 92/71
6,044,751 A * 4/2000 Kimura et al. ..... 92/71
6,308,615 B1 * 10/2001 Takenaka et al. ..... 92/71
6,378,415 B1 * 4/2002 Sugiura et al. ..... 92/71

FOREIGN PATENT DOCUMENTS

JP A-8-199327 8/1996
JP A-09-209926 8/1997

OTHER PUBLICATIONS

Industrial Material from the catalogue by Mitsui Taotsu Chemical Company, 1988, 36(12), p. 120. The properties, functions and characteristics of polyetheretherketone is described.

* cited by examiner

*Primary Examiner*—Edward K. Look
*Assistant Examiner*—Thomas E. Lazo
(74) *Attorney, Agent, or Firm*—Woodcock Washburn LLP

(57) ABSTRACT

A compressor performing a compression action and having a sliding location where one member slides with respect to another member, wherein the sliding portion is formed with sliding layers comprised of a binder comprised of polyetheretherketone and a solid lubricant dispersed in the binder.

4 Claims, 2 Drawing Sheets

COMPRESSOR

BACKGROUND OF THE INVENTION

1. Field of the Invention

The present invention relates to a compressor used for a vehicle air-conditioning system etc.

2. Description of the Related Art

A refrigeration circuit used in a vehicle air-conditioning system includes a compressor for compressing a refrigerant gas. This compressor comes in various forms such as variable displacement types and fixed displacement types. More specifically, fixed displacement type compressors include not only single-headed piston type swash plate compressors, but also double-headed piston type swash plate compressors. Variable displacement type compressors also include not only single-headed piston type swash plate compressors, but also double-headed piston type swash plate compressors.

Among these compressors, for example a single-headed piston type swash plate compressor defines and forms inside its housing cylinder bores, a crank chamber, a suction chamber, and a discharge chamber. Each cylinder bore accommodates a single-headed piston so that it may reciprocate. Further, a drive shaft supported rotatably by the housing is driven by an engine or another external drive source. The swash plate is supported by the drive shaft to be able to synchronously rotate with the drive shaft. A pair of shoes is accommodated in a pair of shoe seats, provided at an engagement portion in the piston, to drive the piston and a shoe is provided at each of the front and rear of the swash plate.

If the swash plate is inclined at a certain angle with respect to the drive shaft, the compressor is a fixed displacement swash plate compressor. If the inclination angle of the swash plate is variable with respect to the drive shaft and the pressure in the crank chamber can be adjusted by a control valve to change the inclination angle and adjust the discharge capacity, it is a variable displacement swash plate compressor. On the other hand, if the piston is a single-headed piston having a head at only one of the front and rear of the swash plate, the compressor is a single-headed piston type swash plate compressor. If the piston is a double-headed piston having heads at both the front and rear of the swash plate, it is a double-headed piston type swash plate compressor.

In this single-headed piston type swash plate compressor, if the drive shaft is driven by an external drive source, the swash plate synchronously rotates, so the pistons reciprocate in the cylinder bores through the shoes. Due to this, each cylinder bore forms a compression chamber with the head of the piston, so when the piston is in the suction stroke, low pressure refrigerant gas is sucked into the compression chamber from the suction chamber connected to an evaporator of the refrigeration circuit. When the piston is in the compression stroke, high pressure refrigerant gas is discharged to the discharge chamber from the compression chamber. This discharge chamber is connected to a condenser of the refrigeration circuit. The refrigeration circuit is used as a vehicle air-conditioning system for air-conditioning a vehicle.

During this time, in the single-headed piston type swash plate compressor, the slidability of the sliding portions between the swash plate and the shoes and between other members is ensured by a mist of lubricating oil contained in the refrigerant gas. Further, it is also possible to form a sliding layer of a sprayed layer for improving the slidability at the sliding portions.

In the above compressors of the related art, however, under severe conditions where the members slide at a high speed with respect to each other or where they slide at the time of a high heat load, the slidability of the sliding portions still was insufficient.

SUMMARY OF THE INVENTION

An object of the present invention is to provide a compressor with sliding portions having a high slidability.

According to the present invention, there is provided a compressor performing a compression action and having a sliding portion where one member slides with respect to another member, wherein the sliding portion is formed with a sliding layer including polyetheretherketone.

Preferably, the sliding layer is comprised of a binder comprised of polyetheretherketone and a solid lubricant dispersed in the binder.

Preferably, the compressor is provided with a swash plate and shoes sliding with the swash plate and sliding with pistons and the sliding layer is formed at least at one sliding portion of said shoes and pistons.

Preferably, the compressor is a swash plate type compressor with the swash plate. The swash plate drives the piston by the shoes accommodated in the piston and thereby the piston performs the compression action. The shoes are formed with sliding portions between one shoe and the swash plate and between the other shoe and the piston and the sliding layer is formed on at least one sliding portion of said swash plate, said shoes and said pistons.

Preferably, a housing of the compressor internally defines and forms cylinder bores, a crank chamber, a suction chamber and a discharge chamber. A drive shaft is rotatably supported by the housing and is driven by an external drive source. Further, the swash plate is supported by the drive shaft to be rotated with the drive shaft and the piston is accommodated in each of the cylinder bores to be able reciprocate therein and to define a compression chamber therein. Further, the swash plate is provided with a pair of shoes accommodated in a pair of shoe seats in the piston at the front and rear of the swash plate and drives the piston through the shoes accommodated in the piston and thereby the piston sucks refrigerant from the suction chamber and discharges compressed refrigerant into the discharge chamber. Further, the shoes are formed with sliding portions between one shoes and the swash plate and between the other shoe and the piston, and the sliding layer is formed on at least one sliding portion of said swash plate, said shoes and said pistons.

BRIEF DESCRIPTION OF THE DRAWINGS

These and other objects and features of the present invention will be more apparent from the following description, with reference to the accompanying drawings, wherein.

DESCRIPTION OF THE PREFERRED EMBODIMENTS

The inventors engaged in intensive research for solving the above problem and discovered that superior effects could be obtained if a sliding layer including polyetheretherketone is formed instead of a known sliding layer.

That is, the compressor of the present invention is a compressor performing a compression action and having a sliding portion where one member slides with respect to another member, wherein the sliding portion is formed with a sliding layer including polyetheretherketone.

In the compressor of the present invention, since the sliding layer includes polyetheretherketone, it is possible to achieve a high slidability performance at sliding portions even under severe conditions such as when one member slides against another member at a high speed or the members slide against each other at the time of a high heat load.

There are various sliding portions in different compressors. For example, in a swash plate compressor provided with a swash plate and shoes sliding with the swash plate and sliding with the pistons, by forming the above sliding layer at least at part of the sliding portions of the swash plate, shoes, and pistons, the effects of the present invention can be realized.

According to the discovery of the inventors, as described in *Kogyo Zairyo* (*Industrial Materials*, August 1988 Supplement (vol. 36, no. 12)), polyetheretherketone (PEEK) is extremely superior in heat resistance and is extremely tough. Therefore, a sliding layer including PEEK is considered to be able to achieve a higher slidability performance compared with a known sliding layer.

The sliding layer is preferably comprised of a binder comprised of polyetheretherketone and a solid lubricant dispersed in the binder. As the solid lubricant, it is possible to employ molybdenum disulfide ($MoS_2$), graphite, tungsten disulfide ($WS_2$), boronitride (BN), polytetrafluoroethylene (PTFE), etc.

To improve the abrasion resistance or to reduce the heat expansion coefficient, it is also possible to disperse carbon fiber or glass fiber etc. in the sliding layer. Further, it is also possible to form a sliding layer comprised of PEEK and a solid lubricant in a manner having continuous pores and impregnate the pores with a lubricating oil. By doing this, a higher slidability performance can be achieved.

Next, a specific example of the present invention will be explained with reference to the drawings.

Figure 1:
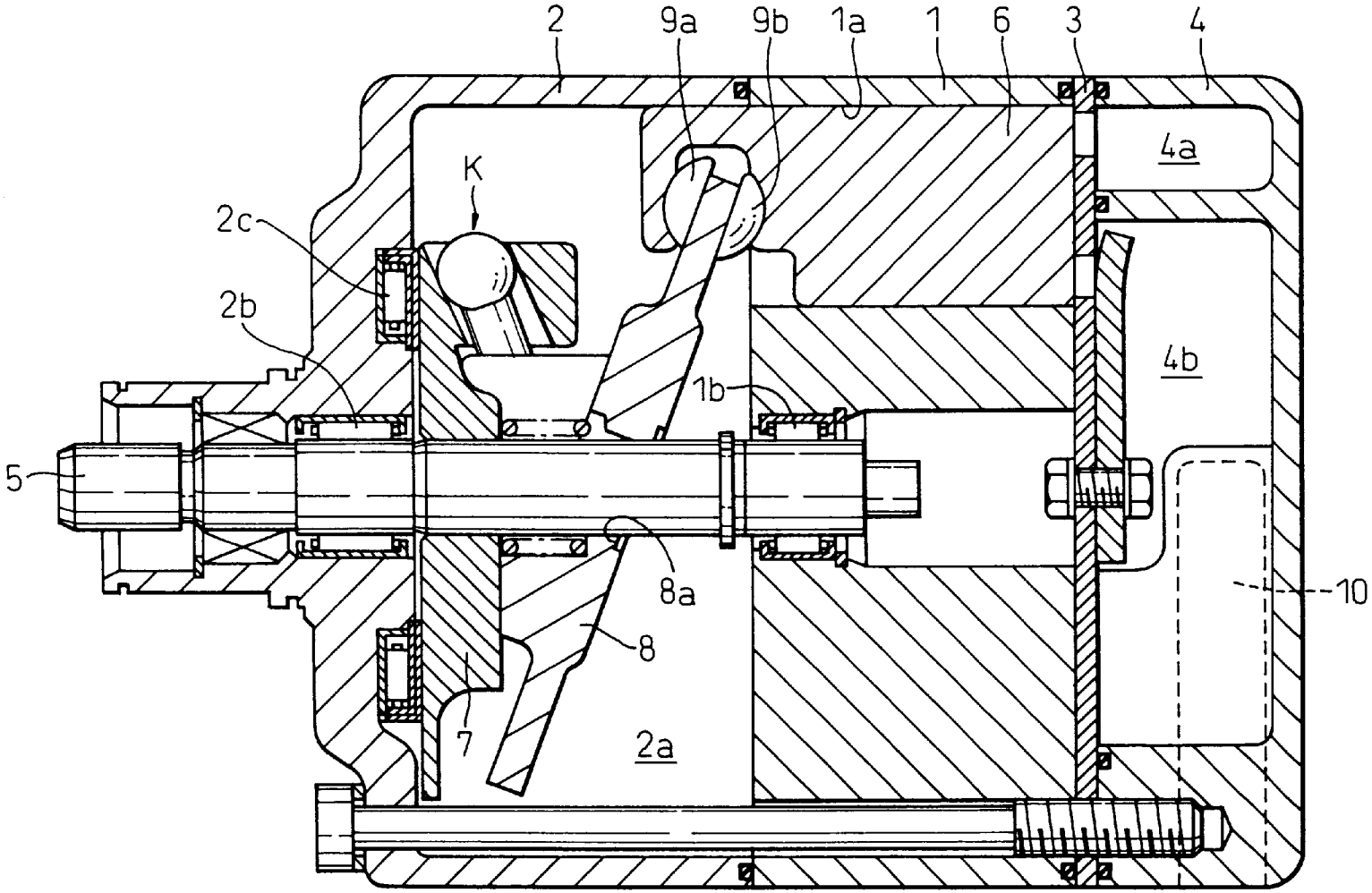
FIG. 1 is a sectional view of a variable displacement single-headed piston type swash plate compressor according to an embodiment of the present invention.

In the variable displacement single-headed piston type swash plate compressor of the present example (hereinafter referred to simply as a "compressor"), as shown in FIG. 1, a front housing 2 is connected to the front end of a cylinder block 1. A crank chamber 2*a* is formed between the cylinder block 1 and the front housing 2. A rear housing 4 is connected to the rear end of the cylinder block 1 through a valve mechanism 3 comprised of suction valves, valve plate, discharge valves, and retainers. A suction chamber 4*a* and a discharge chamber 4*b* are formed in the rear housing 4. The suction chamber 4*a* is connected to a not shown evaporator, the evaporator is connected through a not shown expansion valve to a not shown condenser, and the condenser is connected to the discharge chamber 4*b*.

The drive shaft 5 is rotatably supported at the front housing 2 and the cylinder block 1 through bearings 2*b*, 1*b*. A plurality of cylinder bores 1*a* parallel with the axis of the drive shaft 5 are formed in the cylinder block 1. A single-headed piston 6 is accommodated in each cylinder bore 1*a* to be able to reciprocate therein.

A rotor 7 is fixed to the drive shaft 5 and the drive shaft 5 is able to rotate in the crank chamber 2*a* through a bearing 2*c* adjacent to the front housing 2. The swash plate 8 is oscillatingly provided adjacent to the rotor 7 through a pair of hinge mechanisms K. A through hole 8*a* is formed in the swash plate 8. The drive shaft 5 is inserted through the through hole 8*a* while allowing oscillating movement of the swash plate 8. A pair of shoes 9*a*, 9*b* are provided at the front and rear of the swash plate 8. The pistons 6 are engaged with the swash plate 8 through a pair of shoes 9*a*, 9*b*. The shoes 9*a*, 9*b* sandwich the swash plate 8, and the flat surface of the shoes 9*a*, 9*b* contact the front and rear surfaces of the swash plate 8. The spherical surfaces of the shoes 9*a*, 9*b* contact a pair of the spherical shoe seats in an engagement portion in the piston 6 to be accommodated therein.

Further, the rear housing 4 houses a control valve 10 connected to the suction chamber 4*a*, the discharge chamber 4*b*, and the crank chamber 2*a*. By adjusting the pressure in the crank chamber 2*a* by the control valve 10, it becomes possible to change the inclination angle of the swash plate 8 and to adjust the discharge capacity.

Figure 2:
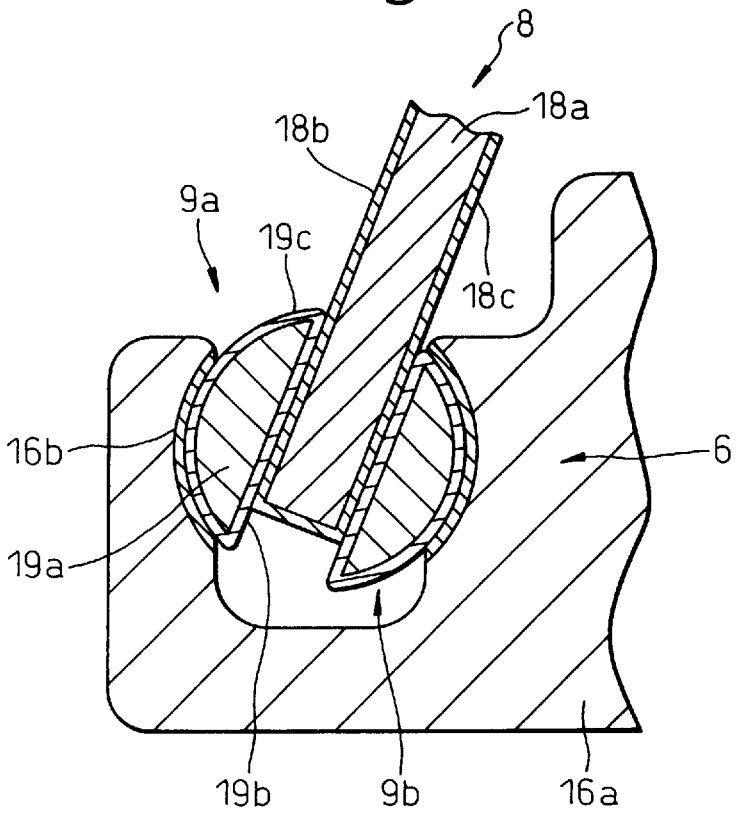
FIG. 2 is an enlarged sectional view of the principal parts of a variable displacement single-headed piston type swash plate compressor according to an embodiment of the present invention.

In the compressor of the above example, as shown in FIG. 2, the swash plate 8 is comprised of a swash plate substrate 18*a* made of a ferrous metal and sliding layers 18*b*, 18*c* formed on the front and rear surfaces of the swash plate substrate 18*a*. Further, each of the front side and rear side shoes 9*a*, 9*b* is comprised of a shoe substrate 19*a* made of a ferrous material and coatings 19*b*, 19*c* made of resin coats formed on the flat part of the shoe substrate 19*a* sliding with the swash plate 8 and the spherical part sliding with the piston 6. Further, each piston 6 is comprised of a piston substrate 16*a* made of an aluminum-based material and a coating 16*b* made of tin plating formed on the shoe seat of the piston substrate 16*a*.

Here, the ferrous material of the swash plate substrate 18*a* and the shoe substrates 19*a* is SUJ2 of the JIS. The sliding layers 18*b*, 18*c* are comprised of polyetheretherketone (PEEK) in which is dispersed polytetrafluoroethylene (PTFE). The "resin coat" means a coating layer obtained by dispersing $MoS_2$ in PAI (polyamidimide). The aluminum-based material of the piston substrate 16*a* is an aluminum alloy containing about 10 wt % of silicon (Si).

Comparative Example 1

As the sliding layer of the swash plate, use was made of polyamidimide (PAI) in which molybdenum disulfide ($MoS_2$) and graphite are dispersed. The rest of the configuration is the same as that of the example of the invention.

Comparative Example 2

Further, as the sliding layer of the swash plate, use was made of polyamidimide (PAI) in which polytetrafluoroethylene (PTFE) is dispersed. The rest of the configuration is the same as that of the example of the invention.

Evaluation

The seizure time (minutes) between the swash plate and shoes was found under conditions of a peripheral speed 10.4 m/sec and a load of 200 kg and no lubrication for the compressors of the example of the invention and Comparative Examples 1 and 2. The results are shown in FIG. 3.

Figure 3:
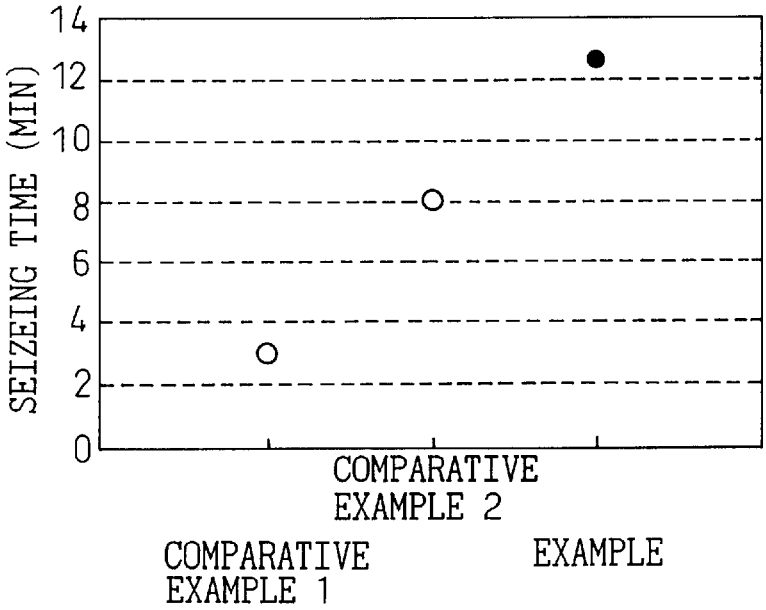
FIG. 3 is graph of the seizure time of sliding portions in the compressors of the Examples and Comparative Examples 1 and 2 obtained from evaluations of performance.

From FIG. 3, it is learned that in the compressor of the example of the invention, since the sliding layers 18*b*, 18*c* are comprised of a binder made of PEEK in which a solid lubricant is dispersed, it is possible to achieve a high slidability performance under severe conditions. That is, in a compressor, where the trend is toward faster speeds, it is possible to achieve a high slidability performance due to the high heat resistance of polyetheretherketone regardless of the increase in heat due to high speed sliding.

While the invention has been described with reference to specific embodiment chosen for purpose of illustration, it should be apparent that numerous modifications could be made thereto by those skilled in the art without departing from the basic concept and scope of the invention.

The present disclosure relates to subject matter contained in Japanese Patent Application No. 2000-225908, filed on Jul. 26, 2000, the disclosure of which is expressly incorporated herein by reference in its entirety.

What is claimed is:

1. A compressor performing a compression action and having a sliding portion where one member slides with respect to another member, wherein the sliding portion is formed with a sliding layer, the sliding layer comprising a binder comprised of polyetheretherketone and a solid lubricant dispersed in the binder.

2. A compressor performing a compression action and having a sliding portion where one member slides with respect to another member, wherein the sliding portion is formed with a sliding layer, wherein the sliding layer is comprised of a binder comprised of polyetheretherketone and a solid lubricant dispersed in the binder, the compressor is provided with a swash plate and shoes sliding with the swash plate and sliding with pistons, and the sliding layer is formed at least at one sliding portion of said swash plate, said shoes and said pistons.

3. A compressor as set forth in claim 2, wherein the compressor is a swash plate type compressor with a swash plate, the swash plate drives the piston by the shoes accommodated in the piston and thereby the piston performs the compression action, the shoes are formed with sliding portions between the shoes and the swash plate and between the shoes and the piston, and the sliding layer is formed on at least one sliding portion of said swash plate, said shoes and said piston.

4. A compressor as set forth in claim 2, wherein a housing of the compressor internally defines and forms cylinder bores, a crank chamber, a suction chamber and a discharge chamber, a drive shaft is rotatably supported by the housing and is driven by an external drive source, the swash plate is supported by the drive shaft to be rotated with the drive shaft, the piston is accommodated in each of the cylinder bores to be able to reciprocate therein and to define a compression chamber therein, the swash plate is provided with a pair of shoes accommodated in a pair of shoe seats in the piston at the front and rear of the swash plate and drives the piston through the shoes accommodated in the piston and thereby the piston sucks refrigerant from the suction chamber and discharges compressed refrigerant into the discharge chamber, the shoes are formed with sliding portions between the shoes and the swash plate and between the shoes and the piston, and the sliding layer is formed on at least one sliding portion of said swash plate, said shoes and said piston.

* * * * *